US005816312A

United States Patent [19]

Suginaka et al.

[11] Patent Number: 5,816,312

[45] Date of Patent: Oct. 6, 1998

[54] METHOD OF AND APPARATUS FOR RECLAIMING FOUNDRY SAND

[75] Inventors: Takashi Suginaka; Toshisaburo Kimura, both of Hiroshima-ken, Japan

[73] Assignee: Mazda Motor Corporation, Japan

[21] Appl. No.: 529,758

[22] Filed: Sep. 18, 1995

[30] Foreign Application Priority Data

| | | | |
|---|---|---|---|
| Sep. 30, 1994 | [JP] | Japan | 6-261147 |
| Jun. 15, 1995 | [JP] | Japan | 7-148736 |

[51] Int. Cl.[6] ..... B22C 5/04; B22C 5/08

[52] U.S. Cl. ..... 164/456; 164/5; 164/155.1; 164/155.6; 366/7; 366/17

[58] Field of Search ..... 164/456, 5, 154.6, 164/155.6, 155.1; 366/7, 17, 152.1

[56] References Cited

U.S. PATENT DOCUMENTS

| | | | |
|---|---|---|---|
| 2,825,946 | 3/1958 | Dietert et al. | 164/155.6 X |
| 2,854,714 | 10/1958 | Dietert et al. | 164/155.6 X |
| 2,863,191 | 12/1958 | Dietert et al. | 366/17 |
| 2,886,868 | 5/1959 | Dietert et al. | 164/155.6 X |
| 2,902,681 | 9/1959 | Dietert et al. | 164/456 X |
| 3,222,736 | 12/1965 | Dietert et al. | 366/152.1 X |
| 3,826,476 | 7/1974 | Ahrenberg | 366/17 |
| 3,838,847 | 10/1974 | Tegelhutter | 366/17 |
| 4,348,867 | 9/1982 | Musschoot | 164/154.6 X |
| 4,709,862 | 12/1987 | Leidel | 164/5 X |
| 5,330,265 | 7/1994 | Keating, Jr. et al. | 366/7 |

FOREIGN PATENT DOCUMENTS

| | | | |
|---|---|---|---|
| 0012047 | 6/1980 | European Pat. Off. | 164/5 |
| 275822 | 2/1990 | Germany | 164/456 |
| 56-53844 | 5/1981 | Japan | 164/456 |
| 58-212834 | 12/1983 | Japan | 164/456 |
| 61-37347 | 2/1986 | Japan | 164/5 |
| 5-212490 | 8/1993 | Japan . | |
| 2066683 | 7/1981 | United Kingdom | 164/5 |

*Primary Examiner*—J. Reed Batten, Jr.
*Attorney, Agent, or Firm*—Sixbey, Friedman, Leedom & Ferguson; Gerald J. Ferguson, Jr.; Jeffrey L. Costellia

[57] ABSTRACT

Salvaged foundry sand is reclaimed by introducing salvaged sand into a vacuum kneading tank, adding water and binder to the salvaged sand and kneading the salvaged sand under vacuum. A target strength value of the reclaimed sand is set and the amount of water and binder to be added to the salvaged sand on the basis of the temperature of the salvaged sand before kneading in the vacuum kneading tank so that reclaimed sand of the target strength value is obtained.

6 Claims, 5 Drawing Sheets

METHOD OF AND APPARATUS FOR RECLAIMING FOUNDRY SAND

BACKGROUND OF THE INVENTION

1. Field of the Invention

This invention relates to a method of and an apparatus for reclaiming salvaged foundry sand using a vacuum kneading tank.

2. Description of the Related Art

As is well known in the art, in a green mold shaping line for shaping a green casting mold, foundry sand is kneaded and shaped into a casting mold, the casting mold is broken after casting, the foundry sand is salvaged and the salvaged sand is kneaded again with virgin sand added as needed to be used for shaping another mold. Thus foundry sand is repeatedly reclaimed and used.

The salvaged sand obtained by breaking a casting mold after casting is at a substantially elevated temperature at the time it is salvaged, and accordingly when the salvaged sand is kneaded as it is, the temperature of the reclaimed sand becomes too high.

Accordingly the salvaged sand is conventionally cooled to a predetermined temperature (generally to a temperature not higher than 40° C.) in a sand cooler and then fed to a kneading tank.

Recently a vacuum kneading tank in which foundry sand is kneaded under a predetermined degree of vacuum has been introduced into some green mold shaping lines and has been put into practice.

When such a vacuum kneading tank is employed, hot foundry sand (e.g., about 40°–70° C.) can be rapidly cooled to a set temperature not higher than 40° C.

That is, when kneading foundry sand and shaping a green mold, normally hot salvaged sand, if necessary together with virgin sand, is introduced into a kneading tank and kneaded with bentonite (as a binder) and a predetermined amount of water. When a vacuum kneading tank is employed as the kneading tank, the boiling temperature of water is lowered due to reduced pressure in the vacuum kneading tank and accordingly part (cooling water to be described later) of the water added to the foundry sand is evaporated robbing the surrounding (i.e., sand) of evaporation latent heat, whereby the sand in the tank is rapidly cooled to a set temperature.

The amount of water added to the foundry sand in the vacuum kneading tank is determined as the sum of water required to keep the water content in the kneaded foundry sand at a predetermined value (humidifying water) and that required to cool the salvaged sand to the set temperature (cooling water). The part of the water evaporated in the kneading tank corresponds to the cooling water.

The amount of water introduced into the kneading tank is controlled so that quality of kneaded sand (salvaged sand) is ensured and a predetermined sand strength (that is, the pressure resistance of the green mold shaped by the salvaged sand) is obtained. It has been known that there is a predetermined correlation between the water content of the sand and the pressure resistance so long as the identity of the sand is the same, and conventionally the water content of the salvaged sand is measured and the amount of water added is controlled so that the water content of the kneaded sand becomes constant on the basis of the measured water content of the salvaged sand according to the correlation.

The water content in the foundry sand after kneading (reclaimed sand) can be divided into a deposited part which is simply deposited on the surface of sand particles and an absorbed part which soaks into the crystal layer of the bentonite. The absorbed water in the crystal layer is less apt to evaporate and improves water retention of the foundry sand. Further the absorbed water is considered to activate bentonite and promote build-up of the sand strength (that is, the pressure resistance of the green mold shaped by the salvaged sand) and at the same time to increase the final sand strength.

Our investigation on the relation between the water content of reclaimed sand after kneading, the temperature of the salvaged sand and the pressure resistance of a green mold has revealed that a green mold shaped from foundry sand kneaded under vacuum exhibits a higher pressure resistance than that shaped from foundry sand kneaded under an atmospheric pressure and at the same time the pressure resistance of a green mold shaped from foundry sand kneaded under vacuum increases as the temperature of the salvaged sand increases for a given water content of reclaimed sand after kneading.

FIG. 5 shows the relation between the pressure resistance of the green mold shaped from foundry sand kneaded in the vacuum kneading tank and the water content in the foundry sand. Lines A and B show the relations for the green molds shaped respectively from reclaimed foundry sand masses obtained by kneading salvaged sand masses at 25° C. and 65° C. with the same proportions of bentonite in the vacuum kneading tank. Lines C and D show the same relations for the green molds shaped respectively from reclaimed foundry sand masses obtained by kneading salvaged sand masses at 25° C. and 65° C. with the same proportions of bentonite under an atmospheric pressure. As can be understood from FIG. 5, when the salvaged sand is kneaded under vacuum, the green mold from the kneaded salvaged sand at 65° C. is higher in the pressure resistance than that from the kneaded salvaged sand at 25° C. Presently it is considered that this is because since the amount of water to be added increases with increase in the temperature of the salvaged sand, a larger amount of steam is generated in the kneading tank and a larger amount of water soaks into the crystal layer of the bentonite, whereby activation of bentonite is more promoted.

Accordingly when the temperature of the salvaged sand is employed as a factor for controlling the amount of water to be added to the vacuum kneading tank, quality of reclaimed sand can be better stabilized.

Further since the pressure resistance of the green mold is increased as the temperature of the salvaged sand increases, a desired pressure resistance of the green mold can be ensured by a reduced amount of binder (bentonite) if the temperature of the salvaged sand is sufficiently high. When the amount of bentonite is reduced, the green mold can be manufactured at a lower cost.

SUMMARY OF THE INVENTION

In view of the foregoing observations and description, the primary object of the present invention is to provide a method of reclaiming salvaged sand in which the quality of obtained reclaimed sand can be better stabilized.

Another object of the present invention is to provide an apparatus for carrying out the method.

Still another object of the present invention is to provide a method of reclaiming salvaged sand which makes it feasible to manufacture a green mold at a lower cost.

Still another object of the present invention is to provide an apparatus for carrying out the method.

In accordance with a first aspect of the present invention, there is provided a method of reclaiming foundry sand comprising the steps of introducing salvaged sand into a vacuum kneading tank, adding water and binder to the salvaged sand and kneading the salvaged sand, wherein the improvement comprises the steps of presetting a target strength value of the reclaimed sand and controlling the amount of water to be added to the salvaged sand on the basis of the temperature of the salvaged sand before kneading in the vacuum kneading tank so that reclaimed sand of the target strength value is obtained.

Virgin sand may be added to the salvaged sand as needed and when virgin sand is added to the salvaged sand, the term "the salvaged sand before kneading" should be broadly interpreted to include mixture of the salvaged sand and the virgin sand.

In one embodiment, the amount of water to be added to the salvaged sand is controlled on the basis of data on the relation between the water content of the salvaged sand and the strength of the reclaimed sand, data on the relation between the temperature of the salvaged sand in the vacuum kneading tank before vacuum kneading and the amount of cooling water required to cool the salvaged sand to a target cooling temperature and the water content of the salvaged sand in the vacuum kneading tank before vacuum kneading.

In accordance with a second aspect of the present invention, there is provided a foundry sand reclaiming apparatus for carrying out the method of the first aspect. The foundry sand reclaiming apparatus comprises a vacuum kneading tank for kneading salvaged sand under a vacuum of a predetermined degree, a salvaged sand supply system for supplying a predetermined amount of salvaged sand to the vacuum kneading tank, a binder supply system for supplying a predetermined amount of binder, a water supply system for supplying a predetermined amount of water to the vacuum kneading tank, a temperature detecting means for detecting the temperature of the salvaged sand in the vacuum kneading tank before kneading under vacuum, a water content detecting means for detecting the water content of the salvaged sand in the vacuum kneading tank before kneading under vacuum, and a control means which controls water supply to the vacuum kneading tank by the water supply system on the basis of data on the relation between the water content of the salvaged sand and the strength of the reclaimed sand, data on the relation between the temperature of the salvaged sand in the vacuum kneading tank before vacuum kneading and the amount of cooling water required to cool the salvaged sand to a target cooling temperature and the water content of the salvaged sand in the vacuum kneading tank before vacuum kneading.

In accordance with the first and second aspects of the present invention, the temperature of the foundry sand (mainly salvaged sand) in the mixer before kneading under vacuum can be taken as a factor for controlling the amount of water to be added, whereby quality of the reclaimed sand can be stabilized as compared with the conventional method where the amount of water to be added is set simply on the basis of the relation between the water content and the strength of the sand. As a result, the strength of the casting mold (green mold) can be kept more uniform, whereby defect in casting is reduced and dimensional accuracy of castings can be improved.

In accordance with a third aspect of the present invention, there is provided a method of reclaiming foundry sand in which salvaged sand and binder is introduced into a vacuum kneading tank, water is added to the salvaged sand and the binder and the salvaged sand is kneaded under vacuum in the vacuum kneading tank, the method characterized in that the amount of water to be added is controlled on the basis of the temperature and the water content of the salvaged sand and the amount of bentonite to be added is controlled on the basis of the temperature of the salvaged sand.

More particularly, the water to be added comprises kneading water for keeping the water content of the foundry sand after kneading under vacuum at a predetermined value and cooling water for cooling the salvaged sand, and the amount of the cooling water is controlled on the basis of the temperature of the salvaged sand.

In accordance with a fourth aspect of the present invention, there is provided a foundry sand reclaiming apparatus for carrying out the method of the third aspect. The foundry sand reclaiming apparatus comprises a vacuum kneading tank for kneading salvaged sand under a vacuum of a predetermined degree, a salvaged sand supply system for supplying a predetermined amount of salvaged sand to the vacuum kneading tank, a binder supply system for supplying a predetermined amount of binder, a water supply system for supplying a predetermined amount of water to the vacuum kneading tank, a temperature detecting means for detecting the temperature of the salvaged sand in the vacuum kneading tank before kneading under vacuum, a water content detecting means for detecting the water content of the salvaged sand in the vacuum kneading tank before kneading under vacuum, and a control means which controls the water supply system to supply water in an amount determined on the basis of the temperature and the water content of the salvaged sand before kneading under vacuum detected by the temperature detecting means and the water content detecting means and controls the binder supply system to supply the binder in an amount determined on the basis of the temperature of the salvaged sand before kneading under vacuum detected by the temperature detecting means.

A desired pressure resistance of the green mold can be obtained by a smaller amount of binder as the temperature of the salvaged sand increases as described above. So, in the third and fourth aspects of the present invention, the relation between the amount of the binder and the temperature of the salvaged sand for obtaining a desired strength of the green mold is obtained in advance, and the amount of the binder to be added is determined according to the relation on the basis of the detected temperature of the salvaged sand. When the amount of the binder is reduced, the green mold can be manufactured at a lower cost.

DESCRIPTION OF THE PREFERRED EMBODIMENT

Figure 1:
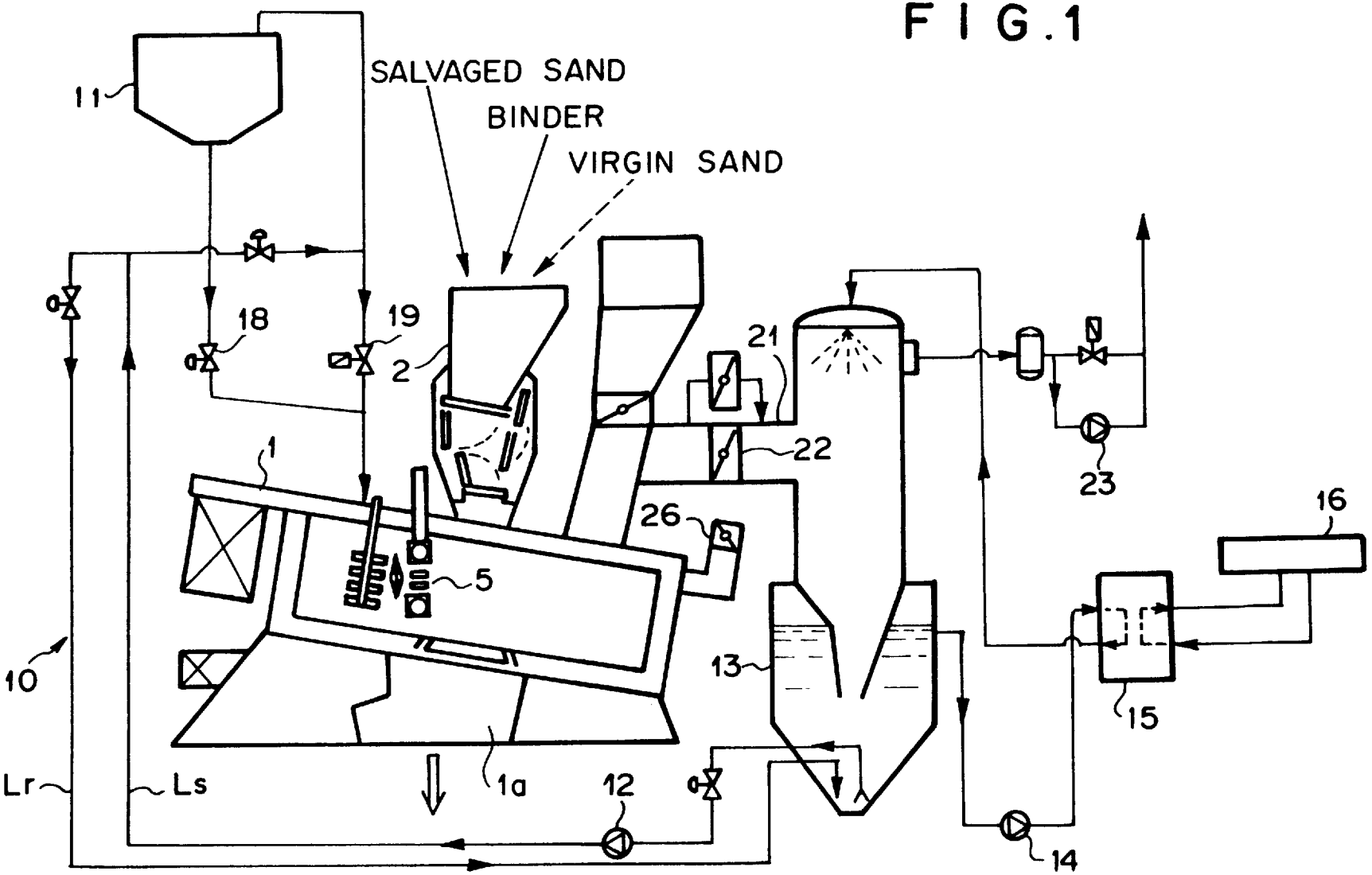
FIG. 1 is a schematic view showing a foundry sand reclaiming apparatus in accordance with an embodiment of the present invention.

In FIG. 1, a foundry sand reclaiming apparatus in accordance with an embodiment of the present invention comprises a vacuum mixer 1 which can knead salvaged sand under a vacuum of a predetermined degree, a metering hopper 2 for introducing predetermined amounts of salvaged sand and binder (e.g., bentonite), (and virgin sand as needed) into the vacuum mixer 1 and a water feed system 10 for feeding a predetermined amount of water to the vacuum mixer 1.

Though not shown in detail, the metering hopper 2 is connected to a salvage station which salvages foundry sand by breaking a sand mold after casting in a green mold shaping line, a bentonite (binder) supply system for supplying bentonite and a virgin sand supply station for supplying virgin sand through a transfer means such as a conveyor mechanism or feeder mechanism.

The water feed system 10 comprises a water meter 11 for metering the amount of water to be supplied to the vacuum mixer 1, a supply pump 12 which sends water under pressure from a condenser 13 to the vacuum mixer 1 through a supply line Ls, and a circulating pump 14 which passes water, returned to the condenser 13 through a return line Lr, through a heat exchanger 15 connected to a cooling tower 16 and returns the same to the condenser 13 and supplies water kept at a substantially constant temperature to the vacuum mixer 1.

Primary and secondary water control valves 18 and 19 are provided downstream of the water meter 11. The primary water control valve 18 is for supplying humidifying or kneading water for keeping the water content of foundry sand after kneading (reclaimed sand) at a predetermined value to the vacuum mixer 1 as primary water. The secondary water control valve 19 is for supplying cooling water for cooling the salvaged sand at an elevated temperature to the vacuum mixer 1 as secondary water. The amount of water to be supplied to the vacuum mixer 1 is controlled by both the primary and secondary water control valves 18 and 19.

A vacuum duct 21 provided with a vacuum shut-off valve 22 at an intermediate portion thereof is connected to the vacuum mixer 1 at one end and to a vacuum pump 23 through the condenser 13 at the other end. When the vacuum pump 23 is operated with the vacuum shut-off valve 22 opened, the inside of the vacuum mixer 1 is evacuated to a vacuum of a predetermined degree. A ventilator valve 26 for introducing atmospheric pressure to the vacuum mixer 1 is connected to the vacuum mixer 1 and when the ventilator valve 26 is opened, the vacuum inside the vacuum mixer 1 is almost instantaneously released.

Figure 2:
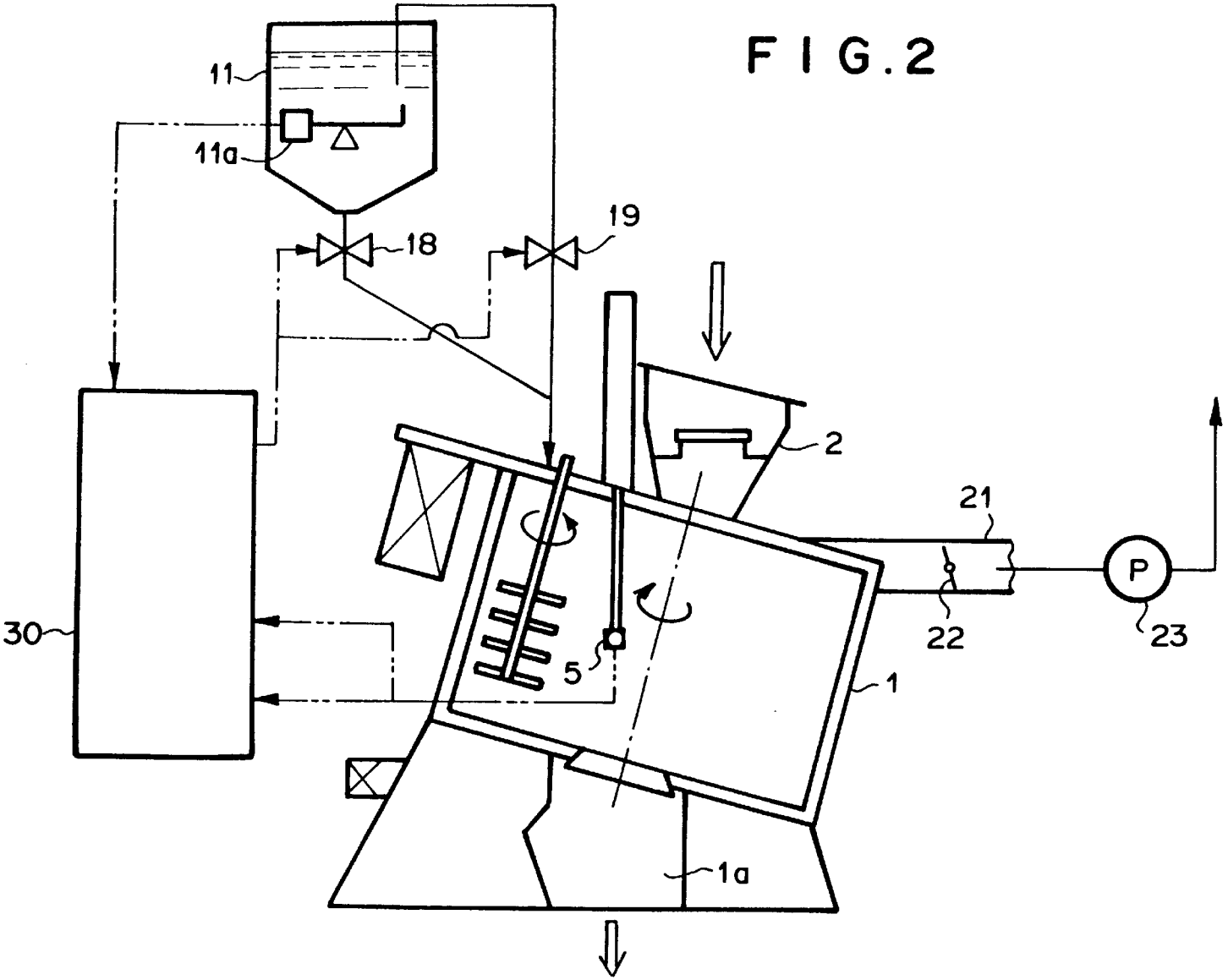
FIG. 2 is an enlarged view showing the vacuum mixer and water supply in the apparatus.

An FK sensor 5 for detecting the temperature and the water content of the salvaged sand introduced into the vacuum mixer 1 is inserted into the vacuum mixer 1. The FK sensor 5 is connected to a control unit 30 (FIG. 2) for controlling the foundry sand reclaiming apparatus and inputs a detecting signal into the control unit 30.

The control unit 30 may comprise, for instance, a microcomputer and a load cell 11*a* in the water meter 11 and the water control valves 18 and 19 are connected to the control unit 30 in addition to the FK sensor 5. A detecting signal from the load cell 11*a* is input into the control unit 30 and control signals are output to the water control valves 18 and 19 from the control unit 30.

Though not shown in detail, various signals such as a detecting signal from a load cell in the metering hopper 2, a water temperature signal which represents the temperature of water in the supply line Ls of the water feed system 10 and the like are further input into the control unit 30, and various control signals are output to the valves such as the vacuum shut-off valve 22 and the ventilator valve 26 and the instruments such as the supply pump 12 and the vacuum pump 23 from the control unit 30.

Figure 3:
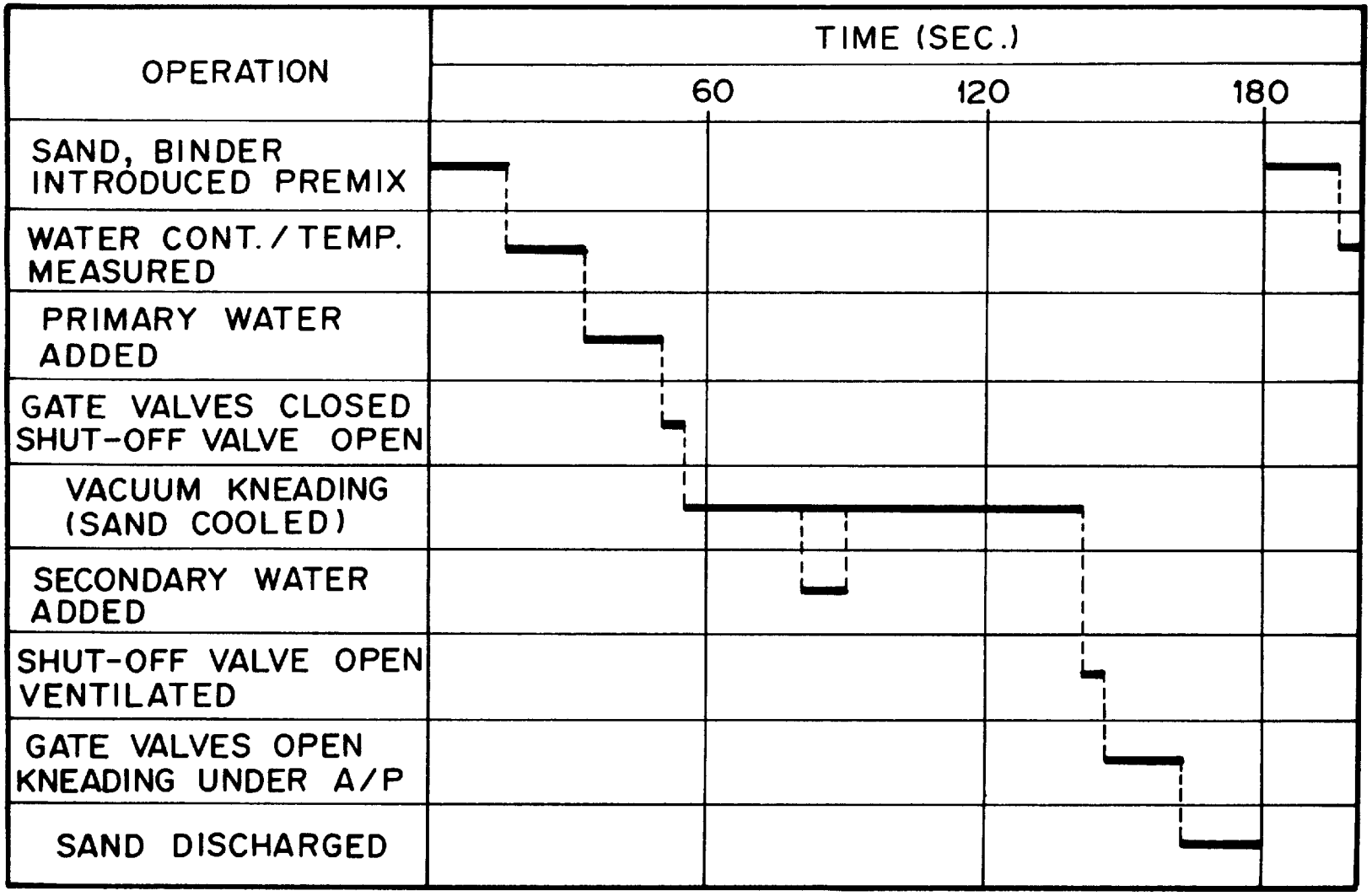
FIG. 3 is a time chart for illustrating the operation of the apparatus.

The operation of the foundry sand reclaiming apparatus of this embodiment will be described with reference to the flow chart shown in FIG. 3, hereinbelow.

According to the control signal from the control unit 30, a predetermined amount of hot salvaged sand is introduced into the metering hopper 2 from the foundry sand salvaging station (not shown) and virgin sand is introduced into the metering hopper 2 from the virgin sand supply station (not shown) as needed. Further a predetermined amount of bentonite is introduced into the metering hopper 2 from the bentonite supply system (not shown). The salvaged sand and the bentonite are premixed for a predetermined time in the vacuum mixer 1. At this time, the inside of the vacuum mixer 1 has not been evacuated and is still held at an atmospheric pressure.

After the premixing, the FK sensor 5 measures the temperature and the water content of the sand in the vacuum mixer 1 and inputs a signal representing the measured temperature and water content into the control unit 30.

As will be described in detail later, the control unit 30 executes a calculation for setting a target water content of the reclaimed sand for a preset target strength of the reclaimed sand on the basis of the measured temperature of the sand before vacuum kneading, calculating the amount of water to be added on the basis of the target water content and the water content of the sand before vacuum kneading measured by the FK sensor 5, and allotting the amount of water to be added to primary water for kneading and secondary water for cooling.

On the basis of the calculation, the amount of primary water is determined and the control unit 30 outputs a control signal to the primary water control valve 18 to open it for a time corresponding to the amount of primary water.

After introduction of the primary water, valves such as gate valves in passages leading to the vacuum mixer 1 are closed and the vacuum shut-off valve 22 is opened. Then the vacuum pump 23 is operated to evacuate the inside of the vacuum mixer 1 to a vacuum of a predetermined degree (in this particular embodiment 74 hpa). The boil temperature of water at 74 hpa is 40° C. Then vacuum kneading is started.

During the vacuum kneading (preferably in the first half of the vacuum kneading), the secondary water for cooling is introduced. That is, under the control of a control signal from the control unit 30, the secondary water control valve 19 is opened for a predetermined time and a predetermined amount of secondary water is introduced into the vacuum mixer 1. As described above, by evaporation of the secondary water, the sand in the vacuum mixer 1 is rapidly cooled to a preset temperature (not higher than 40° C. in this particular embodiment).

After the vacuum kneading, the vacuum shut-off valve 22 is closed and the ventilator valve 26 is opened, whereby the inside of the vacuum mixer 1 is returned to an atmospheric pressure. Then the gate valves are opened and kneading is effected for a predetermined time under the atmospheric pressure. Thereafter reclaimed sand containing therein the preset amount of water (that is, of preset strength) is discharged through a discharge port 1*a* of the vacuum mixer 1 to be reused for shaping a casting mold.

Thus one cycle of reclaiming process is effected. In this particular embodiment, one cycle time is 180 seconds.

In this embodiment, the amount of water to be added is controlled by setting a target water content of the reclaimed sand for a preset target strength of the reclaimed sand on the basis of the measured temperature of the sand (mainly of salvaged sand) in the vacuum mixer 1 before vacuum kneading, calculating the amount of water to be added on the basis of the target water content and the water content of the sand before vacuum kneading measured by the FK sensor 5, and allotting the amount of water to be added to primary water for kneading and secondary water for cooling as described above.

The control of the amount of water to be added will be described in more detail, hereinbelow. In this embodiment, no virgin sand is added in vacuum kneading and only salvaged sand is fed to the metering hopper 2.

First a target strength of reclaimed sand to be obtained (that is, a target pressure resistance of a green mold shaped from the reclaimed sand obtained) is set. In this embodiment, the target pressure resistance is set to 2.0 $kgf/cm^2$. Actually a pressure resistance of about 1.8 $kgf/cm^2$ is sufficient.

For the target pressure resistance, a target water content of the reclaimed sand to be obtained is set on the basis of the temperature of the foundry sand in the vacuum mixer 1 before vacuum kneading.

Figure 5:
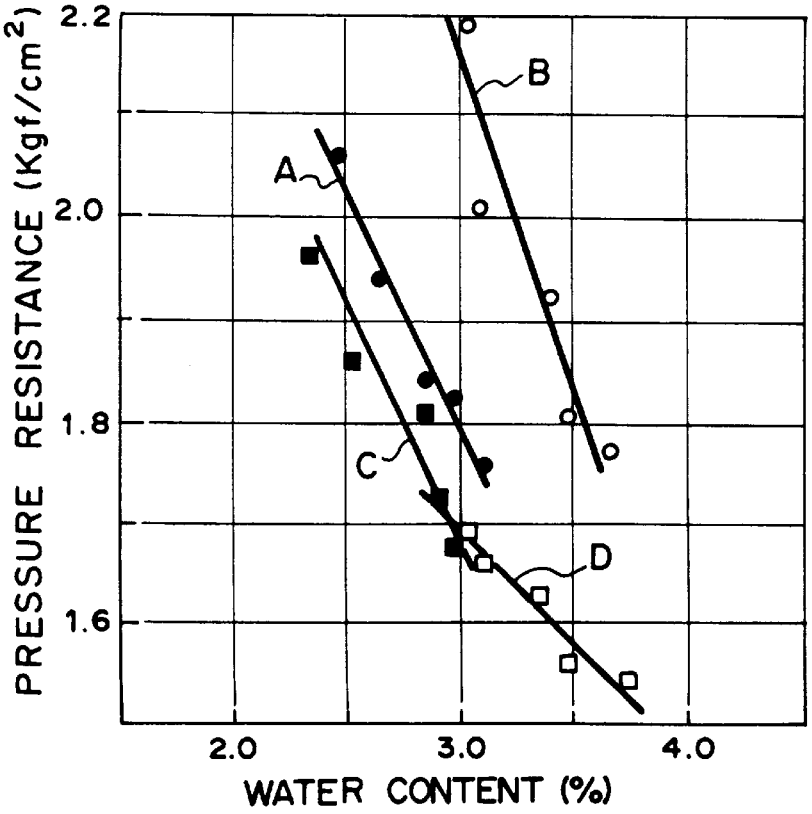
FIG. 5 is a graph showing the relation between the water content of the reclaimed sand and the pressure resistance of the green mold.

That is, as described before in conjunction with FIG. 5, the pressure resistance of a green mold shaped from foundry sand kneaded under vacuum increases as the temperature of the salvaged sand increases for a given water content of reclaimed sand after kneading. Accordingly, by taking data similar to the graph shown in FIG. 5 for various temperatures of the foundry sand in the vacuum mixer 1 before kneading under vacuum (salvaged sand) as base data and referring the temperature of the salvaged sand measured by the FK sensor 5 to the base data, the target water content of the reclaimed sand after vacuum kneading can be set according to the measured temperature of the salvaged sand. The target water content thus set is input into the control unit 30.

Instead of inputting the target water content, it is possible to store the base data in a memory in the control unit 30 and input only a target pressure resistance to the control unit 30 so that the control unit 30 automatically sets the target water content of the reclaimed sand referring the temperature of the salvaged sand measured by the FK sensor 5 to the base data stored in the memory.

The control unit 30 calculates the total amount of water to be added to the vacuum mixer 1 on the basis of the target water content of the reclaimed sand thus set and the water content of the foundry sand in the vacuum mixer 1 before kneading under vacuum measured by the FK sensor 5.

Figure 4:
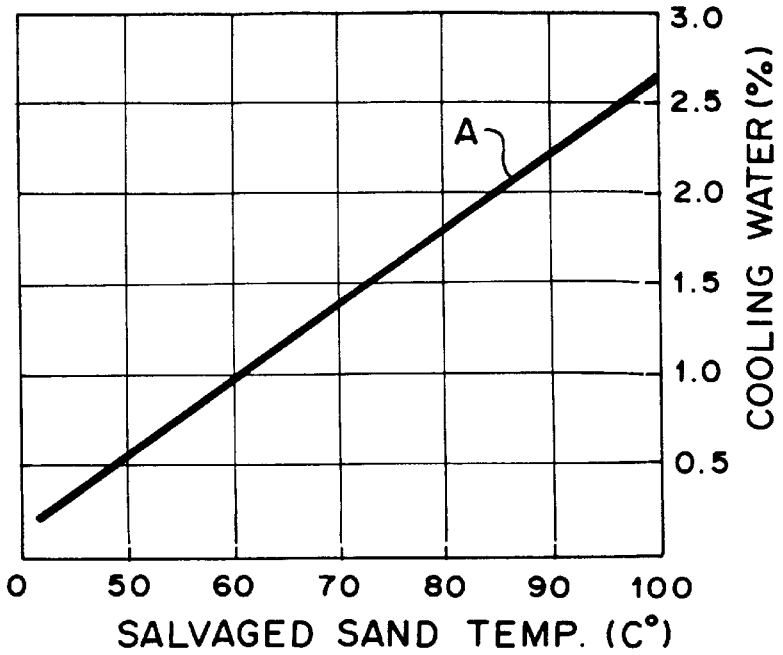
FIG. 4 is a graph showing the relation between the temperature of the salvaged sand and the amount of cooling water.

When the cooling temperature in the vacuum mixer 1 or the degree of vacuum during vacuum kneading is set, there is a certain relation between the temperature of the salvaged sand before vacuum kneading and the amount of secondary water to be added for cooling. An example of the relation is shown in FIG. 4. Line A in FIG. 4 shows the relation for the cooling temperature of 40° C. or the degree of vacuum of 74 hpa. By changing the set value of the cooling temperature or the degree of vacuum, a series of graphs parallel to line A are obtained.

The amount of the secondary water to be added is calculated according to the following equation (an energy equation before and after cooling).

$$P \cdot t + Ms \cdot Cps \cdot T1 + Mw,X1 \cdot Cw \cdot T1 + Mw,\Delta X \cdot Cw \cdot Tw + Mw,k \cdot Cw \cdot Tw = Ms \cdot Cps \cdot T2 + Mw,X2 \cdot Cw \cdot T2 + Mw,\Delta X \cdot Cw \cdot T2 + Mw,k \cdot \{Cw \cdot Tsa + \Delta Hv(Tsa)\} + Qab$$

In the equation, the respective characters represent as follows.

Kw: mixer drive force

P: energy applied to the mixer motor t: kneading time

M: weight of the salvaged sand

X1: water content of the salvaged sand

Ms: dry weight of the salvaged sand [M·(1−X1/100)]

Cps: specific heat of the sand

T1: temperature of the salvaged sand

Mw,X1: wet weight of the salvaged sand [M·X1/100]

Cw: specific heat of water

X2: target water content

Mw,ΔX: weight of kneading water [X2/100·M−Mw,X1]

Tw: temperature of kneading water

Mw,k: weight of cooling water

T2: target temperature of the sand

Tsa: mean evaporating temperature [(T1+T2)/2]

ΔHv: evaporation latent heat [function of the evaporating temperature]

Qab: heat dissipation from the mixer

Thus the amount of cooling water to be added as the secondary water can be calculated on the basis of the temperature of the salvaged sand measured by the FK sensor 5 and the data described above. The amount of kneading water to be added as the primary water is calculated on the basis of the total amount of water to be added and the amount of cooling water. In this manner, the total amount of water can be optimally allotted to the primary water and the secondary water.

As can be understood from the description above, in accordance with the embodiment of the present invention, the temperature of the foundry sand (salvaged sand) in the mixer before kneading under vacuum can be taken as a factor for controlling the amount of water to be added, whereby quality of the reclaimed sand can be stabilized as compared with the conventional method where the amount of water to be added is set simply on the basis of the relation between the water content and the strength of the sand. As a result, the strength of the casting mold (green mold) can be kept more uniform, whereby defect in casting is reduced and dimensional accuracy of castings can be improved.

Figure 6:
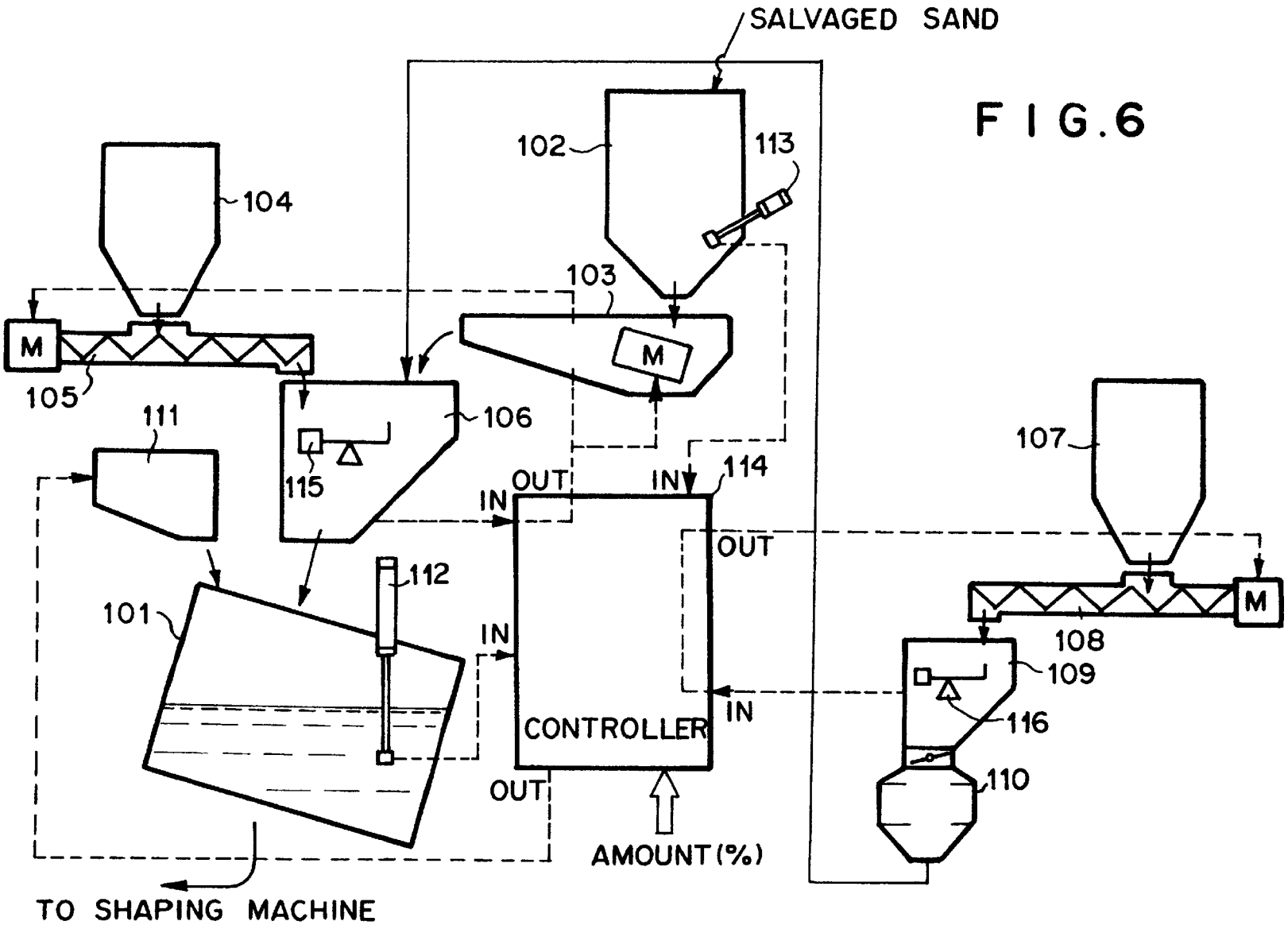
FIG. 6 is a schematic view showing a foundry sand reclaiming apparatus in accordance with another embodiment of the present invention.

A foundry sand reclaiming apparatus in accordance with another embodiment of the present invention will be described with reference to FIG. 6, hereinbelow.

The foundry sand reclaiming apparatus of this embodiment comprises a sand supplier including a vacuum kneading tank 101, a salvaged sand hopper 102, a vibrating feeder 103, a virgin sand hopper 104, a screw conveyor 105, and a sand meter 106 for metering salvaged sand and virgin sand, a bentonite supplier including a bentonite hopper 107, a screw conveyor 108, a bentonite meter 109 and a pressure tank 110, a water meter 111, a temperature sensor 112 provided in the vacuum kneading tank 101, a water content sensor 113 provided in the salvaged sand hopper 102 and an operational controller 114 which controls the suppliers on the basis of signals from the temperature sensor 112 and the water content sensor 113. M denotes a drive motor for each device.

The amount of cooling water is proportional to the specific heat of the sand and is set to be 0 when the temperature of the supplied sand is equal to the set temperature of the vacuum kneading tank 101 (the temperature of the sand after kneading, e.g., 40° C.) and to increase as the temperature of the supplied sand increases. The amount of bentonite is set to be a maximum when the temperature of the supplied sand is equal to the set temperature of the vacuum kneading tank 101 and to decrease as the temperature of the supplied sand increases. The amounts of cooling water and bentonite to be added are input into the operational controller 114 in advance. When the temperature of the supplied sand is lower than the set temperature of the vacuum kneading tank 101, the amount of cooling water is set to 0 and the amount of bentonite is set to the maximum.

The operation of the foundry sand reclaiming apparatus of this embodiment will be described, hereinbelow. First hot salvaged sand is fed to the sand meter 106 from the salvaged sand hopper 102 through the vibrating feeder 103 and virgin sand is fed to the sand meter 106 from the virgin sand hopper 104 through the screw conveyor 105 as needed under the control of a signal from the operational controller 114. The weight of the sand is measured by a load cell 115 in the sand meter 106 and the measuring signal is input into the operational control 114 during the measurement. When the weight of the sand reaches a predetermined value, the operational controller 114 stops the vibrating feeder 103 and the screw conveyor 105. The water content of the salvaged sand is measured by the water content sensor 113 in the salvaged sand hopper 102 and the measuring signal is input into the operational control 114.

Thereafter the sand in the sand meter 106 is fed to the vacuum kneading tank 101 and premixed in the vacuum kneading tank under an atmospheric pressure. The temperature of the sand at this time is measured by the temperature sensor 112 and the measuring signal is input into the operational controller 114. The operational controller 114 calculates the amount of water required to keep the water content of the reclaimed sand after kneading at a predetermined value on the basis of the measured water content of the salvaged sand and calculates the amount of cooling water and the amount of bentonite to be added on the basis of the measured temperature of the sand. Then the total amount of water and the amount of bentonite are calculated according to the weight of the sand.

Bentonite is fed to the bentonite meter 109 from the bentonite hopper 107 through the screw conveyor 108 and the amount of bentonite is measured by a load cell 116 under the control of a signal from the operational controller 114. The measuring signal is input into the operational control 114 during the measurement and when the amount of bentonite reaches the calculated value, the operational controller 114 stops the screw conveyor 108. Then the bentonite in the bentonite meter 109 is transferred to the pressure tank 110 and is fed to the vacuum kneading tank 101 through the sand meter 106 by pressurized air.

At the same time, water is fed to the vacuum kneading tank 101 from the water meter 111 under the control of a signal from the operational controller 114.

After the sand, bentonite and water are supplied to the vacuum kneading tank 101, the inside of the tank is evacuated and the sand, bentonite and water are kneaded for a predetermined time under vacuum. Thereafter the inside of the vacuum kneading tank 101 is returned to an atmospheric pressure and the reclaimed sand is sent to a mold shaping machine.

Though, in the embodiment described above, a relation between the temperature of the sand and the amount of bentonite is set and the amount of bentonite is directly calculated from the measured temperature of the sand, since as the temperature of the sand increases and the amount of cooling water increases, the amount of bentonite may be reduced, it is possible to set a relation of the amount of cooling water and the amount of bentonite and input into the operation controller 114 so that the amount of cooling water is calculated on the basis of the measured temperature of the sand and the amount of bentonite is calculated on the basis of the amount of cooling water.

In accordance with this embodiment, the amount of bentonite can be reduced while ensuring the strength of a green mold shaped by reclaimed sand, thereby reducing the cost for manufacturing the green mold.

What is claimed is:

1. A method of reclaiming foundry sand comprising the steps of introducing salvaged sand into a vacuum kneading tank, adding water and binder to the salvaged sand and kneading the salvaged sand to form reclaimed sand, wherein the improvement comprises the steps of:

presetting a target strength value of the reclaimed sand;

measuring temperature and water content of the salvaged sand before kneading;

controlling a first amount of cooling water and the amount of binder to be added to the salvaged sand on the basis of the temperature of the salvaged sand before kneading in the vacuum kneading tank and controlling a second amount of kneading water to be added to the salvaged sand on the basis of the water content of the salvaged sand so that the reclaimed sand of the target strength value is obtained.

2. A method as defined in claim 1 in which the amount of water to be added is controlled on the basis of data on the relation between the water content of the salvaged sand and the strength of the reclaimed sand, data on the relation between the temperature of the salvaged sand in the vacuum kneading tank before vacuum kneading and the amount of cooling water required to cool the salvaged sand to a target cooling temperature and the water content of the salvaged sand in the vacuum kneading tank before vacuum kneading.

3. A method as defined in claim 1 in which the binder is bentonite.

4. A method as defined in claim 1 wherein the amount of the cooling water is increased as the temperature of the sand exceeds a predetermined temperature.

5. A method as defined in claim 1 wherein the amount of the binder is reduced as the temperature of the sand exceeds a predetermined temperature.

6. A foundry sand reclaiming apparatus comprising for obtaining reclaimed sand;

a vacuum kneading tank for kneading salvaged sand under a vacuum of a predetermined degree, a salvaged sand supply system for supplying a predetermined amount of salvaged sand to the vacuum kneading tank, a binder supply system for supplying a predetermined amount of binder, a water supply system for supplying a predetermined amount of water to the vacuum kneading tank, a temperature detecting means for detecting the temperature of the salvaged sand in the vacuum kneading tank before kneading under vacuum, a water content detecting means for detecting the water content of the salvaged sand in the vacuum kneading tank before kneading under vacuum, and a water and binder control means for controlling water supply to the vacuum kneading tank by the water supply system on the basis of data on the relation between the water content of the salvaged sand and the strength of the reclaimed sand, data on the relation between the temperature of the salvaged sand in the vacuum kneading tank before vacuum kneading and the amount of cooling water required to cool the salvaged sand to a target cooling temperature and the water content of the salvaged sand in the vacuum kneading tank before vacuum kneading and for controlling binder supply to the salvaged sand by the binder supply system on the basis of the temperature of the salvaged sand, so that the reclaimed sand of a target strength value is obtained.

* * * * *